US012599188B2

(12) United States Patent
Lee

(10) Patent No.: US 12,599,188 B2
(45) Date of Patent: Apr. 14, 2026

(54) HOOK-CLASP STRUCTURE AND UNDERWEAR BACK CLASP

(71) Applicant: Chun Wai Candy Lee, Hong Kong (CN)

(72) Inventor: Chun Wai Candy Lee, Hong Kong (CN)

( * ) Notice: Subject to any disclaimer, the term of this patent is extended or adjusted under 35 U.S.C. 154(b) by 0 days.

(21) Appl. No.: 18/613,300

(22) Filed: Mar. 22, 2024

(65) Prior Publication Data

US 2024/0225161 A1 Jul. 11, 2024

Related U.S. Application Data

(63) Continuation of application No. PCT/CN2023/132071, filed on Nov. 16, 2023.

(30) Foreign Application Priority Data

Nov. 17, 2022 (CN) ..... 202211440908.5

(51) Int. Cl.
*A41F 1/00* (2006.01)

(52) U.S. Cl.
CPC ..... *A41F 1/006* (2013.01)

(58) Field of Classification Search
CPC ..... A41F 1/006; F16B 45/00; F16B 45/002; F16B 45/005; F16B 45/012
See application file for complete search history.

(56) References Cited

U.S. PATENT DOCUMENTS 485,389 A * 11/1892 Killinger ..... F16B 45/036 24/601.3
626,691 A * 6/1899 Guilbert ..... F16B 45/036 24/601.3

(Continued)

FOREIGN PATENT DOCUMENTS

CH 25003 A 3/1903
CN 201640559 U 11/2010

(Continued)

OTHER PUBLICATIONS

International Search Report issued in corresponding International application No. PCT/CN2023/132071, mailed Jan. 9, 2024.

(Continued)

*Primary Examiner* — Jack W Lavinder
(74) *Attorney, Agent, or Firm* — HOWARD M COHN and Associates, LLC

(57) ABSTRACT

The invention discloses a hook-clasp structure and underwear back clasp, which belongs to the technical field of underwear accessories, comprising a clasp hole and a hook, one end of the clasp hole is provided with a positioning ring, the other end of the clasp hole is provided with a step clasp position, one end of the hook is provided with a positioning ring, the other end of the hook is provided with a hook portion, the step clasp position protrudes away from the bottom surface of the positioning ring of the clasp hole, the hook is clasped on the step clasp position through the hook portion, so as to be clasped with the clasp hole, a step clasp position protruding away from the back surface of the human body is provided on the clasp hole.

7 Claims, 6 Drawing Sheets

(56) References Cited

U.S. PATENT DOCUMENTS

| | | | | | |
|---|---|---|---|---|---|
| 628,143 | A * | 7/1899 | Groeschel | F16B 45/036 | 24/601.3 |
| 853,377 | A * | 5/1907 | Reid | F16B 45/012 | 24/601.3 |
| 1,202,366 | A * | 10/1916 | Cordingly | F16B 45/012 | 24/601.3 |
| 2013/0199005 | A1 * | 8/2013 | Fung | A44B 13/0058 | 24/698.2 |
| 2023/0000215 | A1 * | 1/2023 | Fung | A44B 13/0029 | |

FOREIGN PATENT DOCUMENTS

| | | | |
|---|---|---|---|
| CN | 205030565 | U | 2/2016 |
| CN | 206659201 | U | 11/2017 |
| CN | 209862406 | U | 12/2019 |
| CN | 211065091 | U | 7/2020 |
| CN | 211092052 | U | 7/2020 |
| CN | 213369945 | U | 6/2021 |
| CN | 216533872 | U | 5/2022 |
| CN | 217446800 | U | 9/2022 |
| CN | 217791586 | U | 11/2022 |
| CN | 219578347 | U | 8/2023 |
| JP | 3228045 | U | 10/2020 |

OTHER PUBLICATIONS

Written Opinion of the International Search Authority in corresponding International application No. PCT/CN2023/132071, mailed Jan. 9, 2024.

* cited by examiner

HOOK-CLASP STRUCTURE AND UNDERWEAR BACK CLASP

CROSS-REFERENCE OF RELATED APPLICATIONS

This application claims priority to Chinese patent application Ser. No. 20/2211440908.5, entitled "A hook-clasp structure and underwear back clasp", filed on Nov. 17, 2022 to China National Intellectual Property Administration, the entire contents of which are incorporated herein by reference.

TECHNICAL FIELD

The invention relates to the technical field of underwear accessories, in particular to a hook-clasp structure and underwear back clasp.

BACKGROUND ART

In traditional hook-clasp structures, the clasp holes are mostly of a planar structure, and some are formed by bending a stepped surface with only a single positioning ring; traditional hooks are mostly bent in a straight manner, with some hook heads embedded in the inner ring of the positioning ring, but no safety sticking point is configured, and only a single positioning ring exists. The above-mentioned traditional hook-clasp structure is close to the cloth layer of the underwear back clasp, which results in a large contact pressing surface, and increases the pressing feeling on the skin; in addition, the bending forming structure usually and easily deforms or even breaks due to stress, affecting the service life of the entire underwear.

SUMMARY

In order to overcome the defects in the prior art, the invention provides a hook-clasp structure and underwear back clasp.

The technical solution adopted by the invention to solve the technical problem is: a hook-clasp structure, comprising:

A clasp hole, one end of which is provided with a positioning ring, and the other end of which is provided with a step clasp position;

A hook, one end of which is provided with a positioning ring, and the other end of which is provided with a hook portion;

The said step clasp position protrudes away from the bottom surface of the positioning ring of the clasp hole, and the hook is clasped on the step clasp position through the hook portion, so as to be clasped with the clasp hole.

Preferably, the said step clasp position comprises a flat clasping section and an inclined extending section, the flat clasping section and the positioning ring of the clasp hole are parallel to each other, the flat clasping section is connected with the positioning ring of the clasp hole through the inclined extending section, the flat clasping section is located on the side of the positioning ring of the clasp hole away from the bottom surface, and the hook portion is clasped on the flat clasping section.

Preferably, two sides of the said clasp hole are respectively provided with a group of positioning rings, and the clasp hole is formed by bending the entire material strip in one piece.

Preferably, a clasp opening is formed between the positioning ring and the hook portion of the said hook, and a side of the positioning ring of the hook facing the hook portion is provided with a safety sticking point.

Preferably, an arc-shaped protrusion is formed at the top of the said safety sticking point, two sides of which form arc-shaped smooth transitions with the positioning ring and the hook portion of the hook respectively.

Preferably, the front end of the said hook portion is provided with a warping portion which is warped away from the clasp opening.

Preferably, the front end of the said hook portion is bent towards the safety sticking point, the rear end of the warping portion and the safety sticking point form a narrow section at the clasp opening, and the front end of the warping portion and the positioning ring of the hook form an outward expansion guide section at the clasp opening.

Preferably, two sides of the said hook are respectively provided with a group of positioning rings, and the hook is formed by bending the entire material strip in one piece.

An underwear back clasp, comprising a first connecting belt, a second connecting belt and the above-mentioned hook-clasp structure, wherein the said clasp hole is provided on the first connecting belt, and the hook is provided on the second connecting belt.

Preferably, the said clasp holes are provided in multiple rows in an array along the length direction of the first connecting belt, and the clasp holes are fixed on the first connecting belt through positioning rings in cooperation with sewing, wherein, the first connecting belt is composed of multiple layers of cloth, the positioning ring of the clasp hole is wrapped in the cloth, the step clasp position penetrates to the outer side of the first connecting belt, ultrasonic pressing points are all provided on the first connecting belt at positions opposite to the step clasp position, the hooks are provided in multiple groups at intervals along the width direction of the second connecting belt, and the hooks are fixed on the second connecting belt through positioning rings in cooperation with sewing.

The beneficial effects of the invention are:

1. A step clasp position protruding away from the back surface of the human body is provided on the clasp hole, so that a space clearance is formed between the step clasp position and the back surface of the human body, and when the hook is clasped on the step clasp position through the hook portion, the front end of the hook portion is placed in the space clearance without contacting the back surface of the human body, thereby effectively avoiding the hook portion from pressing the back surface of the human body to bring discomfort to the human body, and compared with the prior art, the overall wearing comfort is better.

2. Since the step clasp position protrudes away from the bottom surface of the positioning ring of the clasp hole, the hook portion of the hook is able to be more conveniently clasped into the step clasp position when worn.

In the figures, 10: clasp hole; 11: step clasp position; 12: flat clasping section; 13: inclined extending section; 20: hook; 21: hook portion; 22: safety sticking point; 23: arc-shaped protrusion; 24: arc-shaped smooth transition; 25: warping portion; 31: positioning ring; 41: space clearance; 42: clasp opening; 43: narrow section; 44: outward expansion guide section; 50: first connecting belt; 51: ultrasonic pressing point; 60: second connecting belt; 61: protruded sticking point.

DETAILED EMBODIMENTS

Detailed embodiments of the invention are further described below with reference to the accompanying drawings. It should be noted that, the description of these embodiments is used to help understand the invention, but does not constitute a limitation on the invention. In addition, the technical features involved in the various embodiments of the invention described below may be combined with each other as long as they do not conflict therebetween.

Embodiment 1

Figure 1:
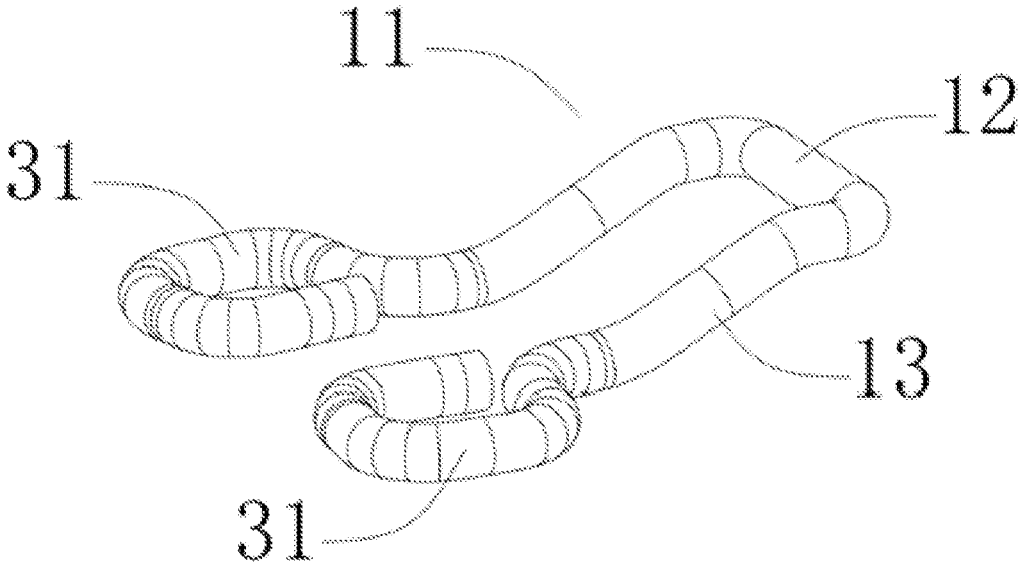
FIG. 1 is a perspective view of a clasp hole according to an embodiment of the invention.
Figure 2:
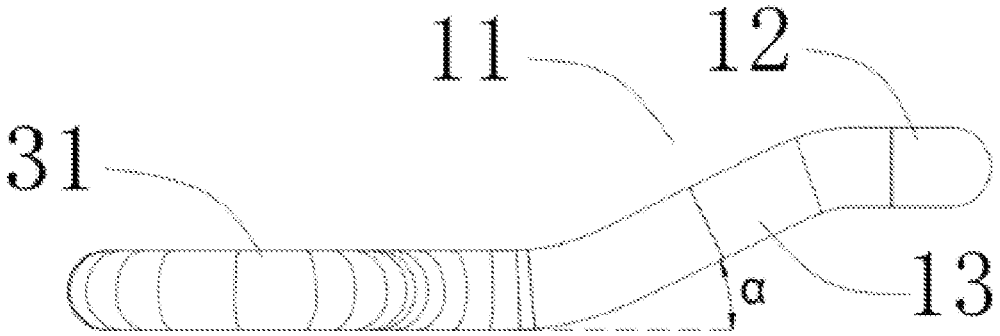
FIG. 2 is a side view of a clasp hole according to an embodiment of the invention.
Figure 3:
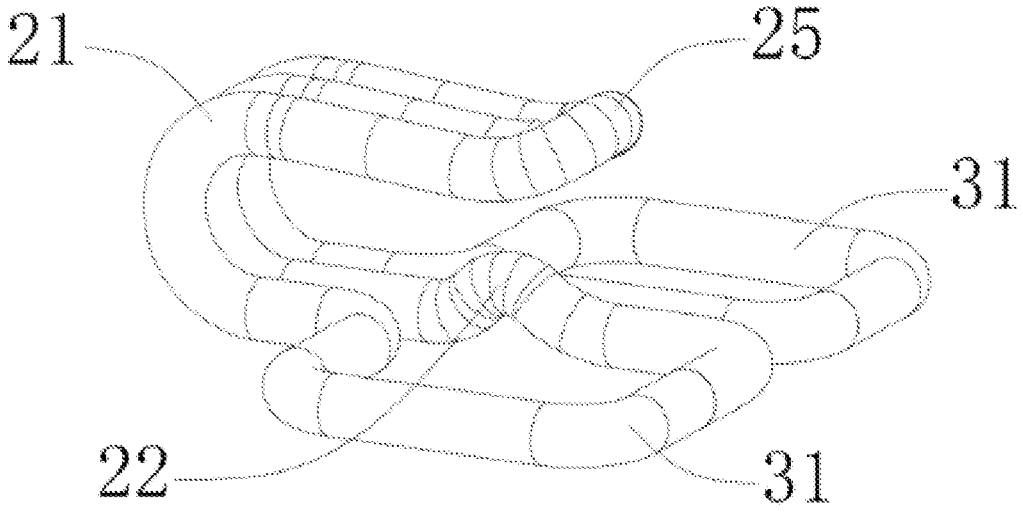
FIG. 3 is a perspective view of a hook according to an embodiment of the invention.
Figure 4:
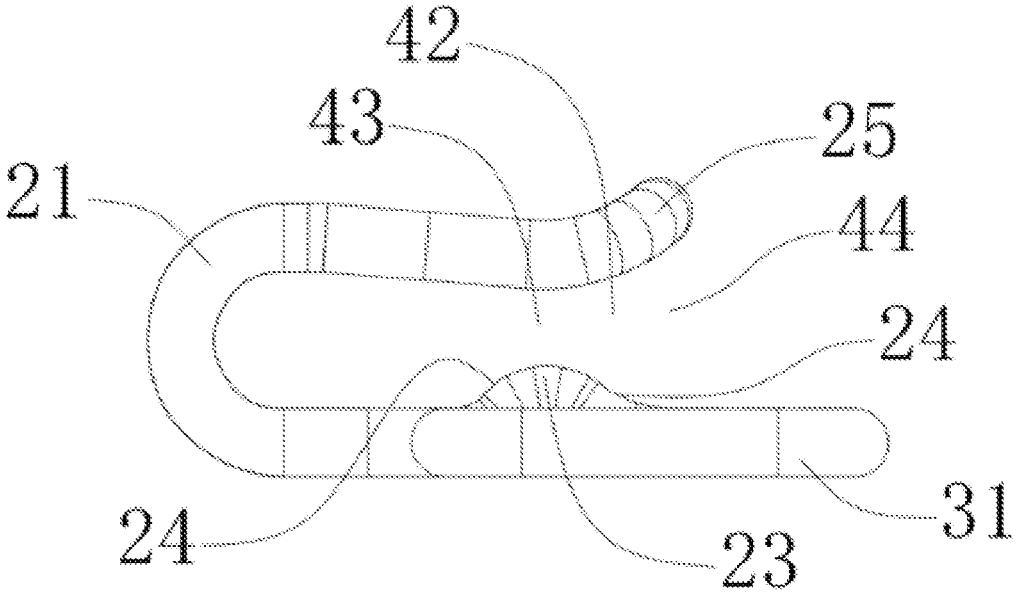
FIG. 4 is a side view of a hook according to an embodiment of the invention.
Figure 5:
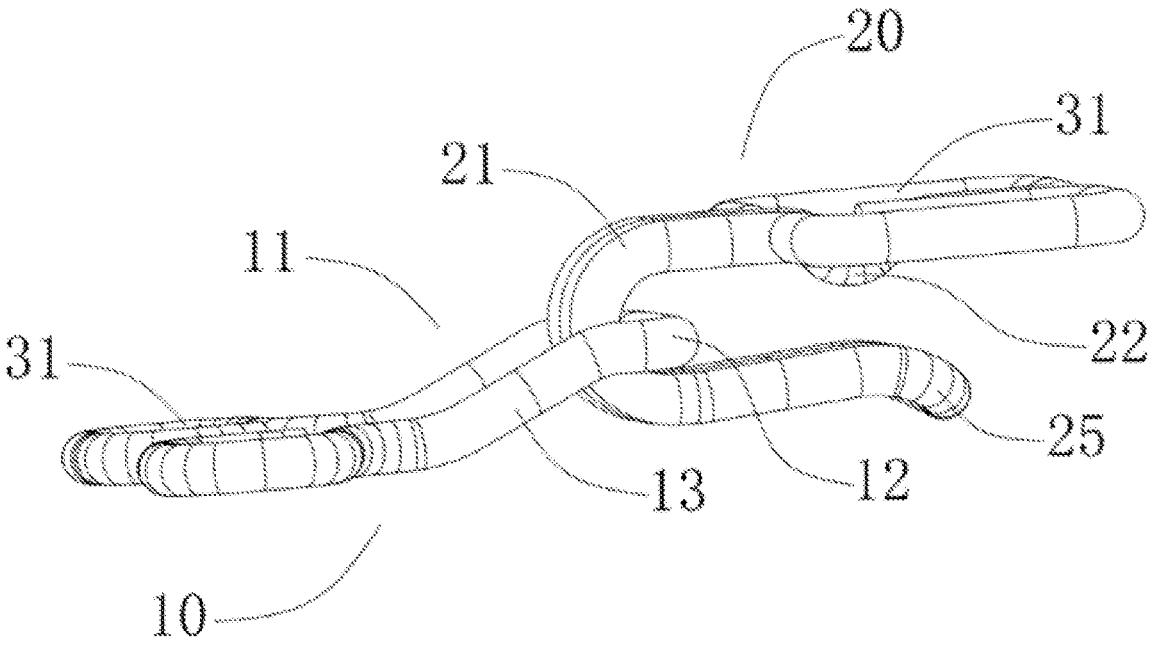
FIG. 5 is a perspective view of a hook-clasp structure according to an embodiment of the invention.
Figure 6:
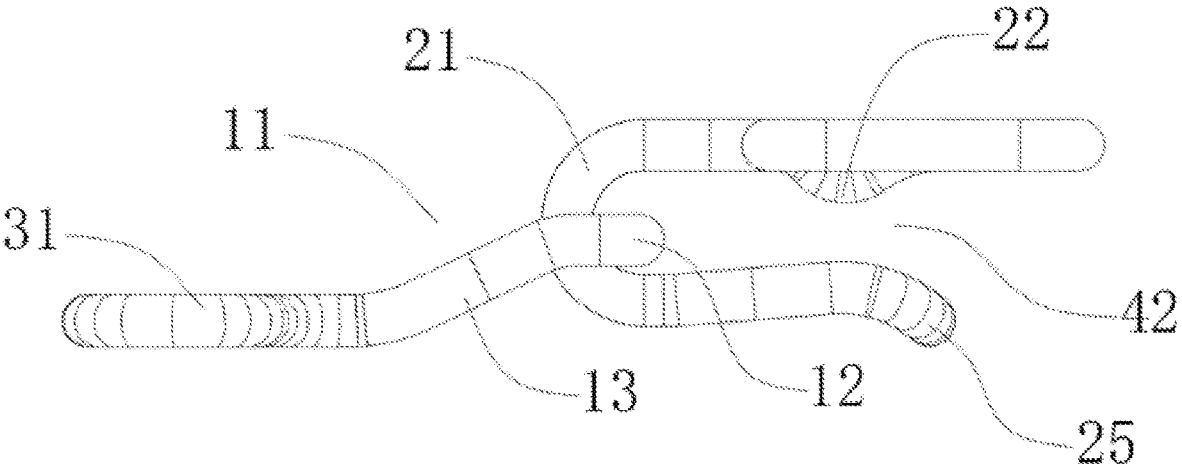
FIG. 6 is a side view of a hook-clasp structure according to an embodiment of the invention.

As shown in FIGS. 1 to 6, the invention provides a hook-clasp structure, comprising:

A clasp hole 10, one end of which is provided with a positioning ring 31 for fixing the clasp hole 10, the other end of which is provided with a step clasp position 11, two sides of the clasp hole 10 are respectively provided with a group of positioning rings 31, and the clasp hole 10 is formed by bending the entire material strip in one piece;

A hook 20, one end of which is provided with a positioning ring 31 for fixing the hook 20, the other end of which is provided with a hook portion 21, two sides of the hook 20 are respectively provided with a group of positioning rings 31, and the hook 20 is formed by bending the entire material strip in one piece;

The step clasp position 11 protrudes away from the bottom surface of the positioning ring 31 of the clasp hole 10, and the hook 20 is clasped on the step clasp position 11 through the hook portion 21, so as to be clasped with the clasp hole 10, in the use state, the positioning ring 31 of the clasp hole 10 is located on the side close to the human body, that is, the positioning ring 31 of the clasp hole 10 is attached to the back surface of the human body, and the step clasp position 11 protrudes away from the back surface of the human body.

Particularly, a step clasp position 11 protruding away from the back surface of the human body is provided on the clasp hole 10, so that a space clearance 41 is formed between the step clasp position 11 and the back surface of the human body, and when the hook 20 is clasped on the step clasp position 11 through the hook portion 21, the front end of the hook portion 21 is placed in the space clearance 41 without contacting the back surface of the human body, thereby effectively avoiding the hook portion 21 from pressing the back surface of the human body to bring discomfort to the human body, and compared with the prior art, the overall wearing comfort is better, meanwhile, since the step clasp position 11 protrudes away from the bottom surface of the positioning ring 31 of the clasp hole 10, the hook portion 21 of the hook 20 is able to be more conveniently clasped into the step clasp position 11 when worn.

Further, the step clasp position 11 comprises a U-shaped flat clasping section 12 and an inclined extending section 13 obliquely provided, the flat clasping section 12 is parallel to the positioning ring 31 of the clasp hole 10, the flat clasping section 12 is connected to the positioning ring 31 of the clasp hole 10 through the inclined extending section 13, the flat clasping section 12 is located on a side of the positioning ring 31 of the clasp hole 10 away from the bottom surface, the hook portion 21 is clasped on the flat clasping section 12, and due to the fact that bending in a straight manner is easy to deform or even break by force, the overall life of the underwear is affected, therefore, by providing the inclined extending section 13, the clasp hole 10 is prevented from bending in a straight manner, and meanwhile, by providing the inclined extending section 13, the comprised angle $\alpha$ between the flat clasping section 12 and the positioning ring 31 of the clasp hole 10 or the plane where the positioning ring 31 of the clasp hole 10 is located is reduced, thereby avoiding that when the flat clasping section 12 is stressed, one side of the positioning ring 31 of the clasp hole 10 is pressed on the back surface of the human body and bring discomfort due to excessive inclined traction of the positioning ring 31 of the clasp hole 10.

Further, a clasp opening 42 is formed between the positioning ring 31 and the hook portion 21 of the hook 20, wherein, in order to prevent the hook 20 from sliding away from the clasp hole 10 too easily, a safety sticking point 22 in cooperation with the flat clasp section 12 is provided on a side of the positioning ring 31 of the hook 20 facing the hook portion 21, the hook portion 21 extends to be opposite to the positioning ring 31 of the hook 20, the safety sticking point 22 is opposite to the clasp opening 42, and in a state that the hook 20 is clasped with the clasp hole 10, the hook portion 21 is limited to a certain extent by the safety sticking point 22 in cooperation with the flat clasp section 12, to prevent the hook portion 21 from sliding away from the flat clasp section 12 too easily.

Further, the axial direction of the safety sticking point 22 is the same as the axial direction of the hook portion 21, an arc-shaped protrusion 23 is formed at the top of the safety sticking point 22, and in the axial direction, two sides of the safety sticking point 22 form arc-shaped smooth transitions 24 with the positioning ring 31 and the hook portion 21 of the hook 20 respectively, and through the arc-shaped smooth transition 24 and the arc-shaped protrusion 23, the flat clasp section 12 is able to be clasped into the hook portion 21 relatively smoothly, which improves the smoothness of clasping, it should be noted that, although the two sides of the safety sticking point 22 are provided with the arc smooth transitions 24, the safety sticking point 22 is not affected to cooperate with the flat clasp section 12 to form a limiting effect on the hook portion 21.

Further, in order to enable the hook portion 21 to be clasped on the flat clasp portion more conveniently, the front end of the hook portion 21 is provided with a warping portion 25 which is warped away from the clasp opening 42, and when the hook portion 21 is clasped into the flat clasp section 12, the warping portion 25 is able to play a guiding role.

Further, in order to improve the limiting effect, the front end of the hook portion 21 is bent toward the safety sticking point 22, the rear end of the warping portion 25 and the safety sticking point 22 form a narrow section 43 in the clasp opening 42, and the front end of the warping portion 25 and the positioning ring 31 of the hook 20 form an outward expansion guide section 44 at the clasp opening 42 for clasping guide.

It should be noted that, in the prior art, a flat hook is formed by bending in a straight manner, a side of which is integrally pressed on the back surface of the human body when worn under the condition that the flat hook is pressed by an external force, that is, the force-bearing point is an entire plane on a side of the flat hook, the area of the friction force-bearing surface is relatively large, and the pressing feeling on the back surface of the human body is increased; by providing the warping portion 25, when being pressed by the external force, only one force-bearing point is formed at the front end of the warping portion 25, and the force-bearing point forms a friction point with a relatively small area, thereby reducing the pressing feeling borne by the back surface of the human body when being pressed by the external force. In addition, when being pressed by an external force, there is only one force-bearing point at the front end of the warping portion 25, and when the front end of the warping portion 25 is stressed, a semi-arc section at the rear end of the warping portion 25 and the rear end of the hook portion 21 is able to form an effective elastic buffer, and after the external force disappears, the front end of the warping portion 25 is pushed to recover through elastic deformation recovery, and through elastic buffer and elastic deformation recovery, plastic deformation of the hook portion 21 due to stress is able be effectively avoided, which improves the service life of the hook-clasp structure.

Figure 7:
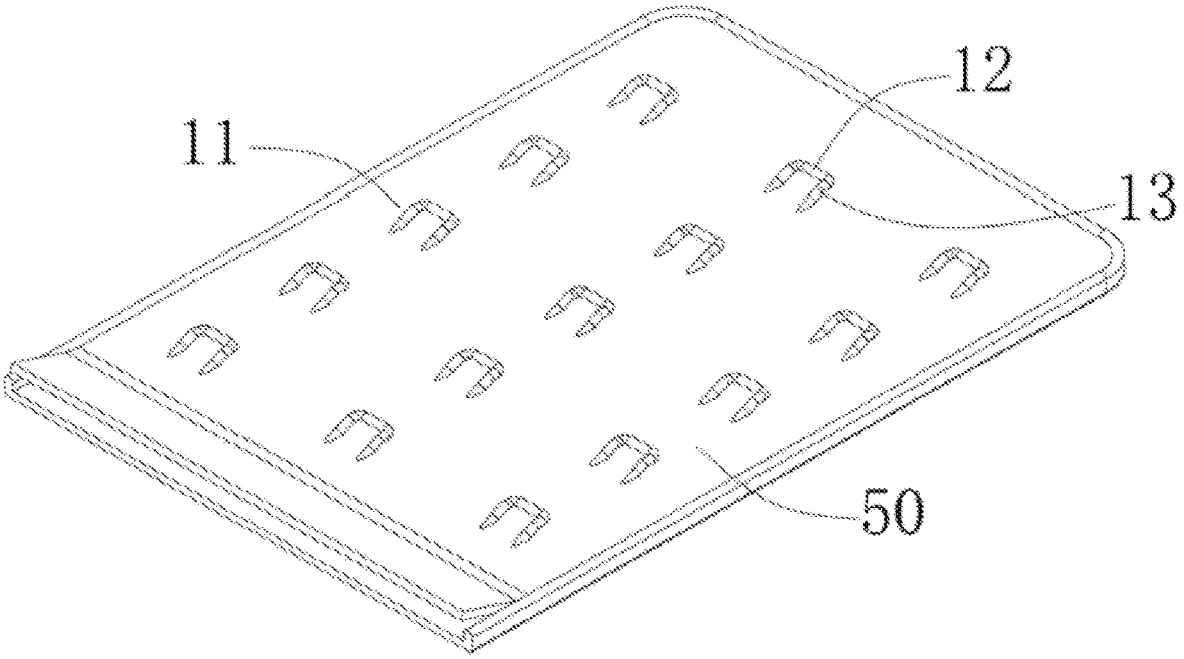
FIG. 7 is a perspective view of a first connecting belt according to Embodiment 1 of the invention.
Figure 8:
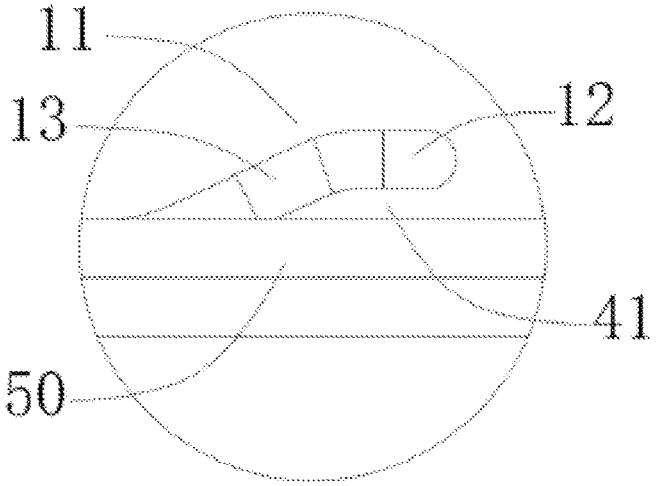
FIG. 8 is a partially enlarged schematic view of a first connecting belt according to an embodiment of the invention.
Figure 9:
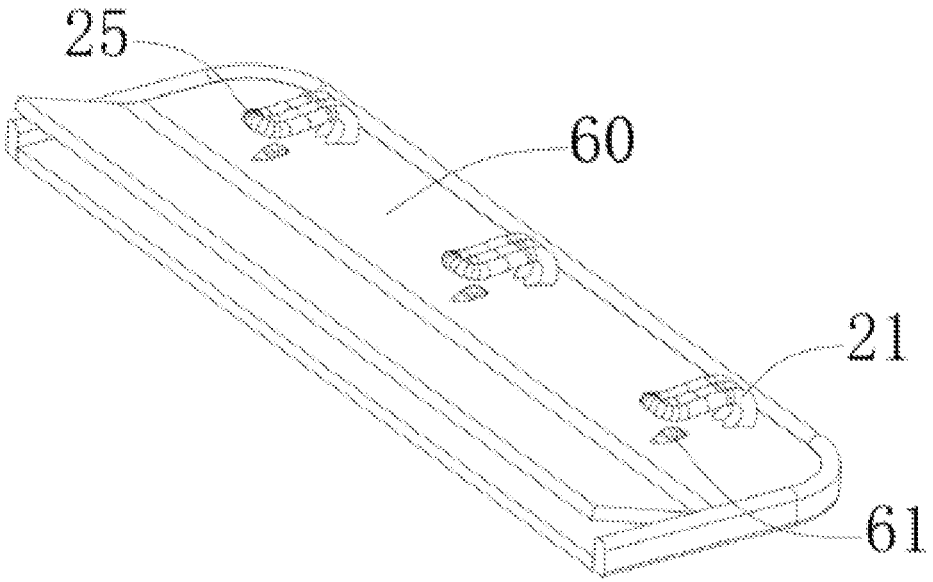
FIG. 9 is a perspective view of a second connecting belt according to an embodiment of the invention.
Figure 10:
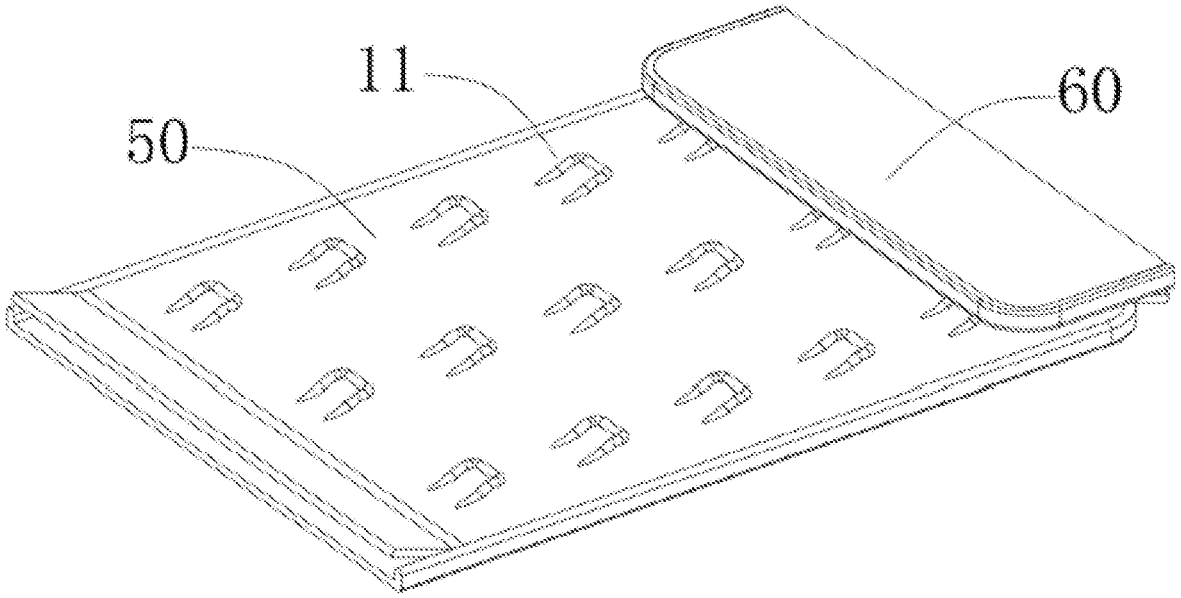
FIG. 10 is a structural schematic view of a clasped underwear back clasp according to Embodiment 1 of the invention.
Figure 11:
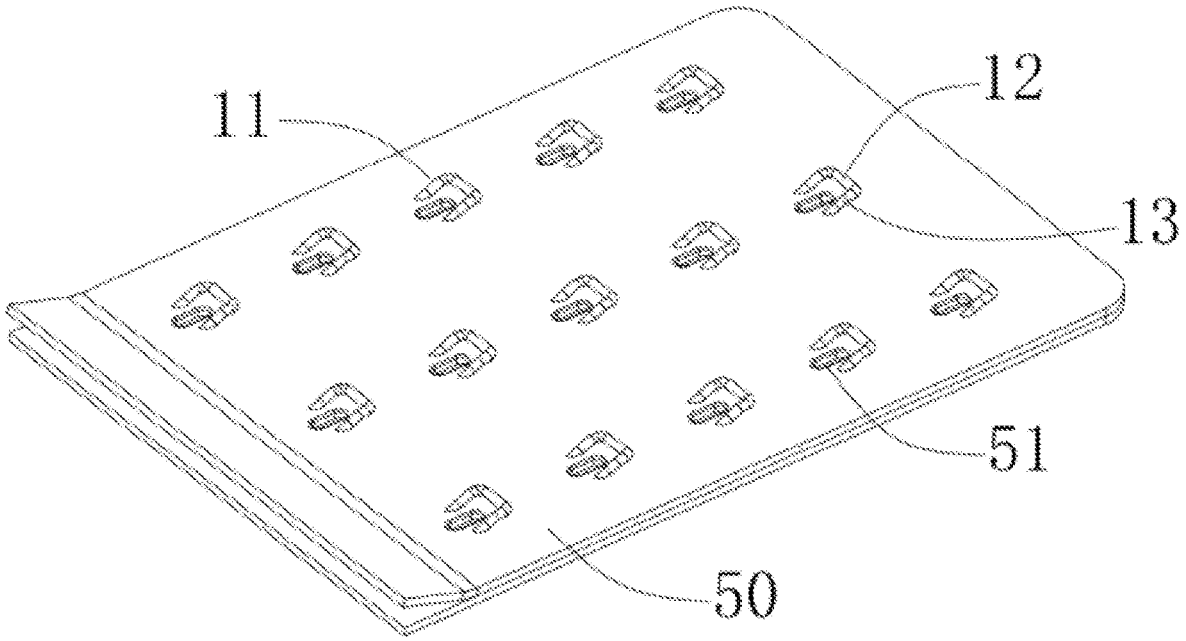
FIG. 11 is a perspective view of a first connecting belt according to Embodiment 2 of the invention.
Figure 12:
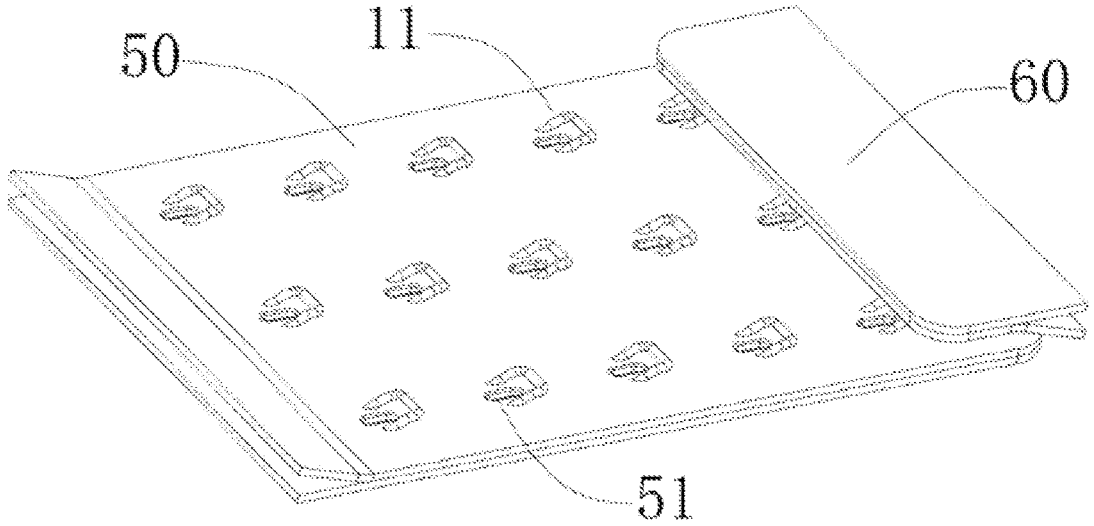
FIG. 12 is a structural schematic view of a clasped underwear back clasp according to Embodiment 2 of the invention.

As shown in FIGS. 7 to 10, an underwear back clasp, comprising a first connecting belt 50, a second connecting belt 60 and the above-mentioned hook-clasp structure, wherein the clasp hole 10 is provided on the first connecting belt 50, and the hook 20 is provided on the second connecting belt 60.

Similarly, a step clasp position 11 protruding away from the back surface of the human body is provided on the clasp hole 10, so that a space clearance 41 is formed between the step clasp position 11 and the belt body of the first connecting belt 50, and when the hook 20 is clasped on the step clasp position 11 through the hook portion 21, the front end of the hook portion 21 is placed in the space clearance 41 without pressing directly on the back surface of the human body, thereby effectively avoiding the hook portion 21 from pressing the back surface of the human body to bring discomfort to the human body, and compared with the prior art, the overall wearing comfort of the underwear back clasp is better, meanwhile, since the step clasp position 11 protrudes away from the bottom surface of the positioning ring 31 of the clasp hole 10, the hook portion 21 of the hook 20 is able to be more conveniently clasped into the step clasp position 11 when worn.

Further, the clasp holes 10 are provided in multiple rows along the length direction of the first connecting belt 50, and the clasp holes 10 are fixed on the first connecting belt 50 through positioning rings 31 in cooperation with sewing, wherein, the first connecting belt 50 is composed of multiple layers of cloth, the positioning ring 31 of the clasp hole 10 is wrapped in the cloth, the step clasp position 11 penetrates to the outer side of the first connecting belt 50; the hooks 20 are provided in multiple groups at intervals along the width direction of the second connecting belt 60, and the hooks 20 are fixed on the second connecting belt 60 through positioning rings 31 in cooperation with sewing; the safety sticking points 22 form protruded sticking points 61 on the second connecting belt 60 by pushing up the cloth, rounded edges are formed on the outer edges of the first connecting belt 50 and the second connecting belt 60 through reverse wrapping of the cloth, and soft rounded edges portion is formed on the two sides of the front ends of the two groups through a rounded reverse wrapping process, avoiding the outer edges form sharp edges and scratch the skin, so that the underwear back clasp is more skin-friendly, and the outer edges is able to be prevented from delaminating due to water washing.

Embodiment 2

The differences between this embodiment and the above-mentioned embodiment lie in that, the clasp holes 10 are provided in multiple rows along the length direction of the first connecting belt 50, and the clasp holes 10 are fixed on the first connecting belt 50 through positioning rings 31 in cooperation with sewing, wherein, the first connecting belt 50 is composed of multiple layers of cloth, the positioning ring 31 of the clasp hole 10 is wrapped in the cloth, the step clasp position 11 penetrates to the outer side of the first connecting belt 50, ultrasonic pressing points 51 for improving the stability of the clasp hole 10 are all provided on the first connecting belt 50 at positions opposite to the step clasp position 11 by ultrasonic hot pressing, the clasp hole 10 is prevented from sliding away from the penetrating hole and the cloth layer is prevented from being separated; the hooks 20 are provided in multiple groups at intervals along the width direction of the second connecting belt 60, and the hooks 20 are fixed on the second connecting belt 60 through positioning rings 31 in cooperation with sewing; the safety sticking points 22 form protruded sticking points 61 on the second connecting belt 60 by pushing up the cloth.

The embodiments of the invention are described in detail above with reference to the accompanying drawings, but the invention is not limited to the described embodiments. For those skilled in the art, without departing from the principles and spirit of the invention, various changes, modifications, substitutions and variations made to these embodiments still fall within the protection scope of the invention.

The invention claimed is:

1. A hook-clasp structure, characterized in that, comprising:

a clasp hole (10), one end of which is provided with a positioning ring (31), and the other end of which is provided with a step clasp position (11);

a hook (20), one end of which is provided with a positioning ring (31), and the other end of which is provided with a hook portion (21);

the said step clasp position (11) protrudes away from the bottom surface of the positioning ring (31) of the clasp hole (10), and the hook (20) is clasped on the step clasp position (11) through the hook portion (21), so as to be clasped with the clasp hole (10);

a clasp opening (42) is formed between the positioning ring (31) and the hook portion (21) of the said hook (20), and a side of the positioning ring (31) of the hook (20) facing the hook portion (21) is provided with a safety sticking point (22);

an arc-shaped protrusion (23) is formed at a top of the safety sticking point (22), two sides of which form arc-shaped smooth transitions (24) with the positioning ring (31) and the hook portion (21) of the hook (20) respectively;

a front end of the hook portion (21) is provided with a warping portion (25) which is warped away from the clasp opening (42).

2. The said hook-clasp structure according to claim 1, characterized in that, the said step clasp position (11) comprises a flat clasping section (12) and an inclined extending section (13), the flat clasping section (12) and the positioning ring (31) of the clasp hole (10) are parallel to each other, the flat clasping section (12) is connected with the positioning ring (31) of the clasp hole (10) through the inclined extending section (13), the flat clasping section (12) is located on the side of the positioning ring (31) of the clasp hole (10) away from the bottom surface, and the hook portion (21) is clasped on the flat clasping section (12).

3. The said hook-clasp structure according to claim 1, characterized in that, two sides of the said clasp hole (10) are respectively provided with a group of positioning rings (31), and the clasp hole (10) is formed by bending the entire material strip in one piece.

4. The said hook-clasp structure according to claim 1, characterized in that, the front end of the hook portion (21) is bent towards the safety sticking point (22), a rear end portion of the warping portion (25) and the safety sticking point (22) form a narrow section (43) at the clasp opening (42), and a front end portion of the warping portion (25) and the positioning ring (31) of the hook (20) form an outward expansion guide section (44) at the clasp opening (42).

5. The said hook-clasp structure according to claim 1, characterized in that, two sides of the said hook (20) are respectively provided with a group of positioning rings (31), and the hook (20) is formed by bending an entire material strip in one piece.

6. An underwear back clasp, characterized in that, comprising a first connecting belt (50), a second connecting belt (60) and the said hook-clasp structure according to claim 1, wherein the said clasp hole (10) is provided on the first connecting belt (50), and the hook (20) is provided on the second connecting belt (60).

7. He said underwear back clasp according to claim 6, characterized in that, a plurality of clasp holes (10) are provided in multiple rows in an array along a lengthwise direction of the first connecting belt (50), and the plurality of clasp holes (10) are fixed on the first connecting belt (50) through positioning rings (31) in cooperation with sewing, wherein, the first connecting belt (50) is composed of multiple layers of cloth, the positioning rings (31) of each of the plurality of clasp holes (10) is wrapped in the cloth, and a step clasp position (11) of each of the plurality of clasp holes (10) penetrates to an outer side of the first connecting belt (50), ultrasonic pressing points (51) are all provided on the first connecting belt (50) at positions opposite to the step clasp position (11) of each of the plurality of clasp holes (10), a plurality of hooks (20) are provided in multiple groups at intervals along a widthwise direction of the second connecting belt (60), and the plurality of hooks (20) are fixed on the second connecting belt (60) through positioning rings (31) in cooperation with sewing.

* * * * *